US012359523B2

(12) United States Patent
Wright et al.

(10) Patent No.: US 12,359,523 B2
(45) Date of Patent: Jul. 15, 2025

(54) WELLHEAD ATTACHMENT SYSTEM

(71) Applicant: Vault Pressure Control, LLC, Houston, TX (US)

(72) Inventors: Knox Wright, Houston, TX (US); Jason Meyer Armistead, Houston, TX (US); Khang Van Nguyen, Tomball, TX (US); Andrew Browne Helvenston, Houston, TX (US)

(73) Assignee: VAULT PRESSURE CONTROL, LLC, Houston, TX (US)

( * ) Notice: Subject to any disclaimer, the term of this patent is extended or adjusted under 35 U.S.C. 154(b) by 0 days.

(21) Appl. No.: 18/439,250

(22) Filed: Feb. 12, 2024

(65) Prior Publication Data

US 2024/0183242 A1 Jun. 6, 2024

Related U.S. Application Data

(63) Continuation-in-part of application No. 18/149,886, filed on Jan. 4, 2023.

(60) Provisional application No. 63/296,328, filed on Jan. 4, 2022.

(51) Int. Cl.
*E21B 17/08* (2006.01)
*E21B 33/04* (2006.01)

(52) U.S. Cl.
CPC ..... *E21B 33/04* (2013.01); *E21B 17/085* (2013.01)

(58) Field of Classification Search
CPC ..... E21B 17/085; E21B 33/04
See application file for complete search history.

(56) References Cited

U.S. PATENT DOCUMENTS

| | | | | |
|---|---|---|---|---|
| 4,771,832 | A * | 9/1988 | Bridges | E21B 33/0422 277/606 |
| 8,960,276 | B2 * | 2/2015 | Lang | E21B 33/12 285/123.14 |
| 10,196,872 | B2 * | 2/2019 | Kauffmann | E21B 33/1212 |
| 10,253,589 | B2 * | 4/2019 | Helvenston | E21B 33/0422 |
| 10,513,914 | B1 * | 12/2019 | Rose | E21B 33/14 |
| 11,920,416 | B2 * | 3/2024 | Cheng | E21B 23/042 |
| 2013/0092397 | A1 * | 4/2013 | He | E21B 33/03 166/208 |
| 2023/0008109 | A1 * | 1/2023 | Sneed | E21B 33/04 |

FOREIGN PATENT DOCUMENTS

| | | | | |
|---|---|---|---|---|
| CN | 107387015 | A * | 11/2017 | E21B 33/04 |
| CN | 113107412 | A * | 7/2021 | E21B 33/04 |

* cited by examiner

*Primary Examiner* — Matthew R Buck
(74) *Attorney, Agent, or Firm* — Morgan, Lewis & Bockius LLP

(57) ABSTRACT

A casing system includes a landing ring and a mandrel hanger. The landing ring defines an opening extending between a first end portion and a second end portion. The first end portion is configured to couple to a conductor pipe. The landing ring includes a landing ring shoulder extending radially inward from an inner surface of the opening. The mandrel hanger has an outer surface configured to engage a load ring and an engagement ring. The load ring also abuts the engagement ring and engages the landing ring shoulder.

20 Claims, 17 Drawing Sheets

WELLHEAD ATTACHMENT SYSTEM

REFERENCE TO RELATED APPLICATIONS

This application is a continuation-in-part of U.S. application Ser. No. 18/149,886 filed Jan. 4, 2023, which claims priority to U.S. 63/296,328 filed Jan. 4, 2022, the entire disclosure of which is incorporated herein by this reference.

TECHNICAL FIELD

The present disclosure relates to tools and methods used in oil and gas operations, and in particular to systems and methods for casing systems used in oil and gas operations.

BACKGROUND

In exploration and production of formation minerals, such as oil and gas, wellbores may be drilled into an underground formation. The wellbores may be cased wellbores where a casing (or tubular piping string) is positioned against a wall of the borehole, where cement may be injected to secure the casing string to the formation. A casing string is typically supported at its upper end by a casing hanger, which is located (or landed) within a wellhead at the surface. At the lower end, the casing string is connected to the wellbore to connect the pressurized well to the surface.

In a conventional casing process, different wellhead arrangements are required depending on whether the drilling rigs utilizes support rings or risers with landing rings. Further, the landing ring designs and riser inner diameter requirements will vary based on the wellhead size and wellhead arrangement. Often slip-on-wellhead housings are required for contingencies, such as stuck casings.

Further, to run certain conventional wellhead attachment systems, the riser pipe must be relatively large in diameter (e.g. an outside diameter of approximately 24-26 inches or have an inner diameter of approximately 23 to 25 inches) to accommodate the running tool and housing. The introduction of certain conventional wellhead systems may require a complicated process of removing plugs, installing studs, re-installing plugs and valves, and then testing the connections. Further, outlets may be installed after the housing has been installed. Additionally, a pin and box riser adapter may be required on many rigs. Therefore, removal of certain conventional risers may be more time consuming because both pieces of the riser adapter will need to be removed. Therefore, the use of conventional casing processes is often more expensive and may involve the use of larger and heavier components and equipment.

Additionally, during installation of the casing, the casing string is run by joining the casing with connections, which may normally be threaded connections. At times, the casing string can become stuck during operations. If the surface casing becomes stuck, the operator will have to disconnect and install alternative equipment requiring special tools and labors. During this period, it is normal to cut the inoperable casing off to provide the proper height for installation into the wellhead.

In certain conventional applications, when the casing becomes stuck, a surface engineering crew has to cut the stuck casing and weld on a replacement casing structure to restart drilling operations. Cutting and welding of the casing may introduce sparks to a hazardous environment and can create a dangerous setting for operations and their personnel. Additionally, surface engineering processes may be costly and time consuming.

Therefore, what is needed is an apparatus, system or method that addresses one or more of the foregoing issues, among one or more other issues.

SUMMARY

In one embodiment, the casing system, comprises a landing ring defining an opening extending between a first end portion and a second end portion, wherein the first end portion is configured to couple to a conductor pipe, the landing ring comprising a landing ring shoulder extending radially inward from an inner surface of the opening; a mandrel hanger configured to extend through the opening of the landing ring; and a load ring coupled to an outer surface of the mandrel hanger, wherein the load ring is configured to engage with the landing ring shoulder.

In another embodiment, the casing system, comprises a landing ring defining an opening extending between a first end portion and a second end portion, wherein the first end portion is configured to couple to a conductor pipe, the landing ring comprising a landing ring shoulder extending radially inward from an inner surface of the opening; and a slip hanger configured to engage with casing, the slip hanger comprises at least one slip segment configured to engage with an outer diameter of the casing; and an outer slip ring disposed around and coupled to the at least one slip segment, wherein the outer slip ring is configured to engage with the landing ring shoulder.

The casing system eliminates the current requirements for running the running tool and housing through a large diameter riser pipe and eliminates the need for welding if a surface casing string gets stuck.

BRIEF DESCRIPTION OF DRAWINGS

The accompanying drawings, which are included to provide further understanding and are incorporated in and constitute a part of this specification, illustrate disclosed embodiments and together with the description serve to explain the principles of the disclosed embodiments. In the drawings.

DETAILED DESCRIPTION

Figure 1:
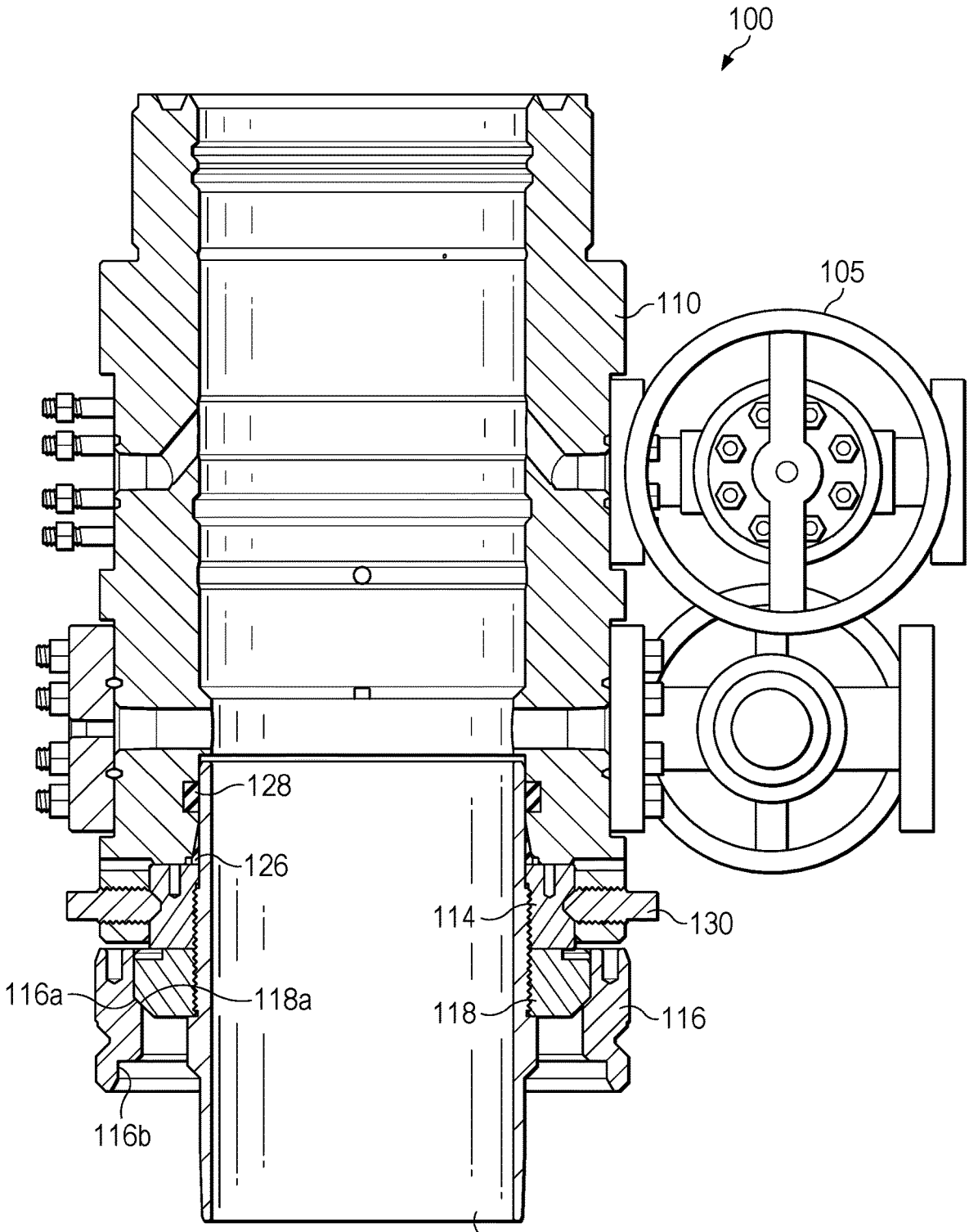
FIG. 1 is a cross-sectional view of an example configuration of a wellhead system, in accordance with embodiments of the present disclosure.

The present disclosure relates generally to tools and methods used in oil and gas operations, and more particularly, to systems and methods for casing systems used in oil and gas operations. As described herein, embodiments of the tool described herein improves upon the traditional methods of installing casing and/or wellheads.

Certain conventional casing systems may utilize dedicated hardware and/or components to support a wellbore which can be time consuming and resource intensive to convey and install. Further, in certain conventional applications, the components utilized to convey and install the wellhead may be relatively large and heavy, requiring the use of relatively large and expensive secondary components, such as large diameter risers or diverters (e.g. risers with inner diameters of approximately 23 to 25 inches and outer diameters of approximately 24 to 26 inches).

Additionally, certain conventional casing systems may utilize different specialized hardware and/or components for installing a wellhead in response to stuck casing contingencies. In these applications, since the hardware to install a wellhead in stuck casing contingencies is different than the hardware used for "routine" wellhead installations, existing hardware cannot be used to rapidly or easily install a wellhead in response to a stuck casing event. Instead, surface engineering personnel must cut and/or weld to install a wellhead in response to a stuck casing event. Cutting and welding the casing may introduce sparks to a potentially hazardous environment and can create a dangerous setting for operations and personnel. Further, since stuck casing contingencies in conventional applications require different equipment than "routine" wellhead installations an operator must maintain an inventory of different or specialized equipment for stuck casing contingencies (e.g. slip-on-wellheads).

Embodiments of the disclosed casing system can utilize components that are lighter and smaller than certain conventional casing systems. Advantageously, the use of lighter and smaller components, such as the disclosed mandrel hanger and other components, can allow for the components to be conveyed to a desired location using smaller, lighter, easier to use, and less expensive running tools and processes, as well as allow for the components to be conveyed through smaller diameter, cheaper, and more commonly available risers or diverters.

Embodiments of the disclosed casing system can utilize a common landing ring to support a wellhead using a mandrel hanger and a load ring, as well as to support a wellhead using a slip hanger, in the event of a stuck casing. In contrast, certain conventional casing systems may utilize conventional landing rings along with corresponding hardware to support a wellhead during a "routine" installation, but conventional landing rings may not be compatible with the hardware that is utilized to install a wellhead for a stuck casing contingency. Therefore, certain conventional casing systems that utilize conventional landing rings may be subject to the drawbacks identified above, including, but not limited to requiring the use of large diameter risers or diverters and/or requiring welding to install a wellhead for a stuck casing contingency. Advantageously, the use of a common landing ring can avoid costly, time-consuming, and potentially dangerous welding operations for stuck casing contingencies. Further, by utilizing a common landing ring for both initial or "routine" wellhead installations as well as for stuck casing contingency wellhead installations, an operator can avoid maintaining an inventory of specialized equipment, such as slip-on-wellheads.

FIG. 1 illustrates a cross sectional side view of an example configuration of a wellhead 110 supported by a wellhead support assembly 100 in accordance with embodiments of the present disclosure. With reference to FIG. 1, the wellhead 110 can be used to control the flow of fluids to and from a wellbore. As illustrated, the wellhead 110 can include one or more valves 105 to control the flow of fluid through the wellhead 110 and the wellbore. In the depicted example, the mandrel hanger 112 can provide fluid communication between the wellhead 110, the casing, and the wellbore.

Figure 2:
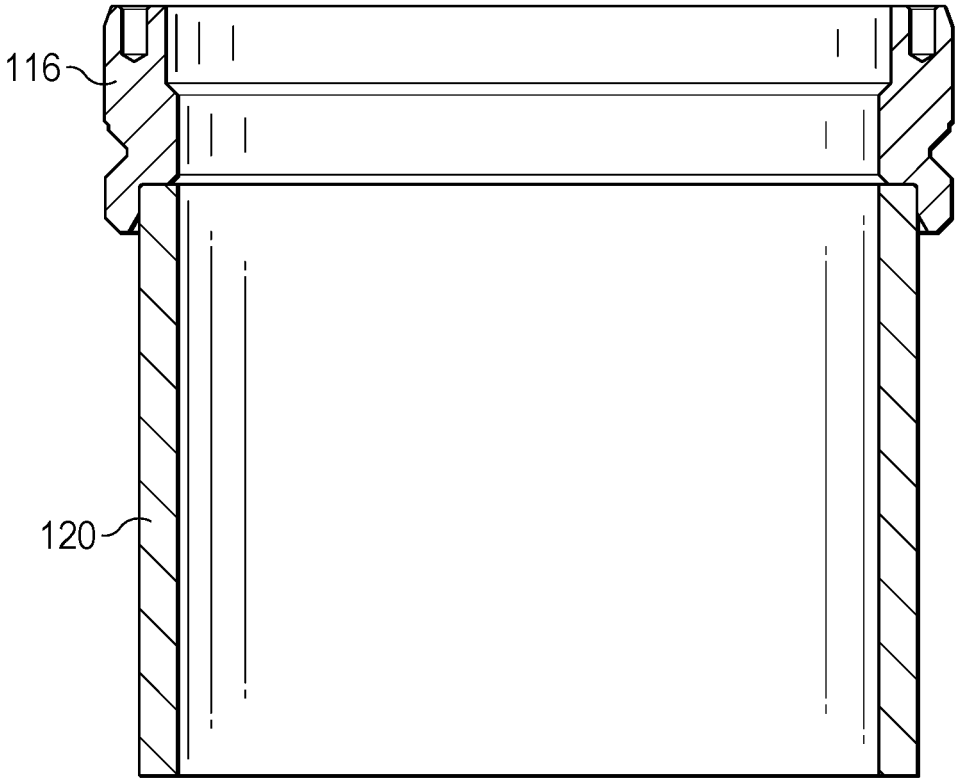
FIG. 2 is a cross-sectional side view of a landing ring connected to a conductor pipe, in accordance with embodiments of the present disclosure.

As illustrated in FIG. 1, the mandrel hanger 112 and an engagement ring 114 can couple and support the wellhead 110 relative to a conductor pipe 120 (as shown in FIG. 2). In some embodiments, the mandrel hanger 112 can extend into a portion of the wellhead 110 to stabilize the wellhead 110 relative to the conductor pipe 120. In some embodiments, certain aspects of installing the wellhead may be described in U.S. Pat. No. 9,534,465 and is incorporated herein by reference.

The mandrel hanger 112 is supported by or coupled to the landing ring 116. In the illustrated embodiment, a load ring 118 is disposed around and coupled to the mandrel hanger 112 to facilitate a connection between the mandrel hanger 112 and the landing ring 116. As illustrated, an outer surface 118*a* of the load ring 118 is configured to engage with an inner surface of the landing ring 116 to support the load of the mandrel hanger 112. In some embodiments, the outer surface 118*a* of the load ring 118 defines an angled or beveled surface configured to engage with a mating surface of the landing ring 116. The angle of the beveled surface can range from approximately 0 degrees to 10 degrees. In some embodiments, the load ring 118 can be integrally formed with the mandrel hanger 112. In some embodiments, an inner surface of the load ring 118 can be coupled to an outer surface of the mandrel hanger 112. For example, the load ring 118 can be threadedly coupled to the mandrel hanger 112.

In the illustrated embodiment, the inner diameter of the landing ring 116 includes a shoulder 116*a* configured to receive the load ring 118. As illustrated, the shoulder 116*a* can extend radially inward from an inner surface of the landing ring 116. The landing ring 116 and landing shoulder 116*a* will include features that are complimentary to the outer surface 118*a* of the load ring 118. As illustrated, the shoulder 116*a* of the landing ring 116 is configured to engage with an outer surface 118*a* of the load ring 118 to support the load of the mandrel hanger 112. In some embodiments, the landing shoulder 116*a* of the landing ring 116 defines an angled or beveled surface configured to engage with a mating surface of the load ring 118. In some embodiments, the angled or beveled surface of the landing shoulder 116*a* and/or the load ring outer surface 118*a* can allow the landing ring 116 and/or the load ring 118 to self-centralize or align during engagement. The angle of the beveled surface of the landing shoulder 116*a* can range from approximately 0 degrees to 10 degrees. As described herein, embodiments of the landing ring 116 can be configured to also receive other components of a casing system, such as a slip hanger or other component that may be used to support a wellhead during a stuck casing event. Advantageously, by configuring the landing ring 116 to receive either a load ring 118 or a slip hanger, an operator can avoid welding operations for stuck casing contingencies and/or avoid maintaining an inventory of specialized equipment.

Figure 7:
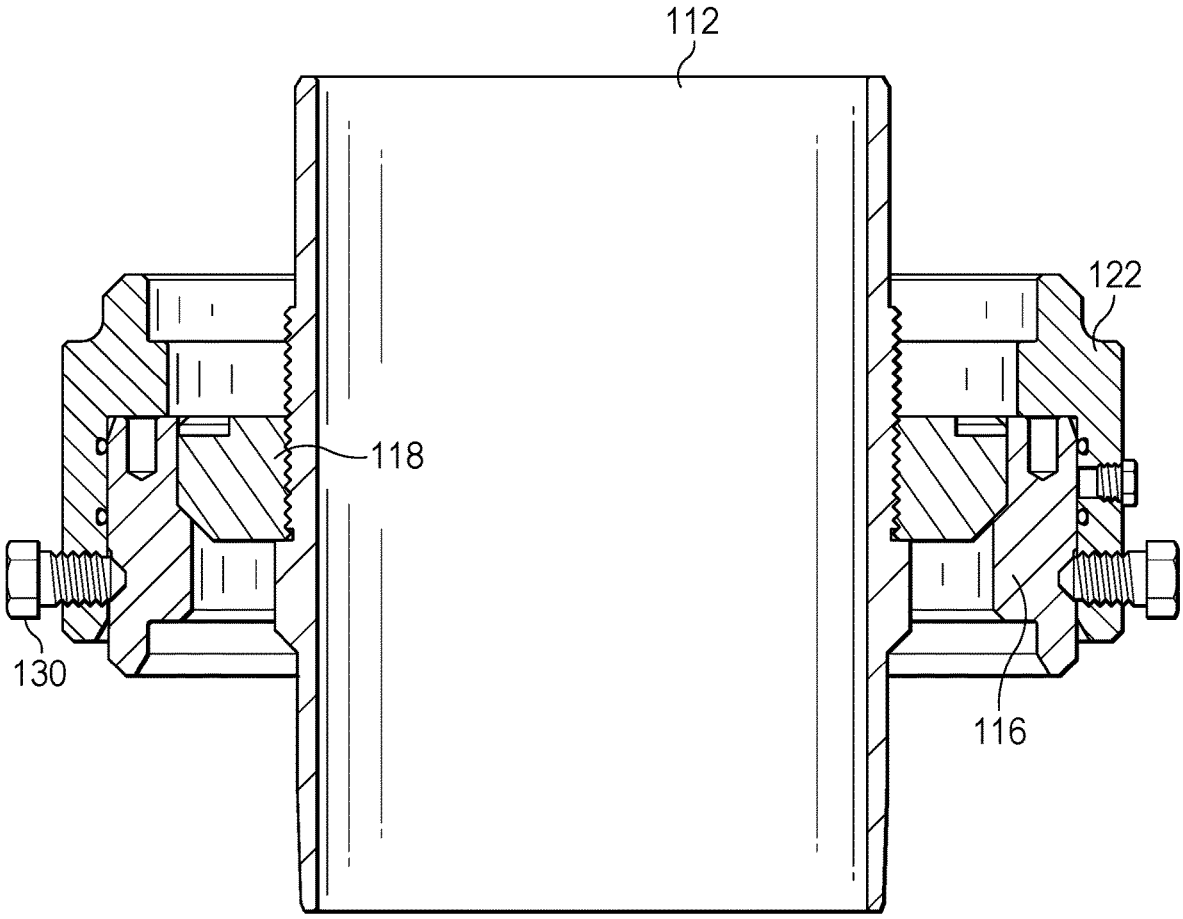
FIG. 7 is a cross-sectional schematic of a mandrel hanger disposed within a landing ring, in accordance with embodiments of the present disclosure.

The landing shoulder 116*a* of the landing ring 116 distributes the load from the load ring 118 and the mandrel hanger 112 to the landing ring 116 and the coupled conductor pipe 120 (as illustrated in FIG. 2). In some embodiments, the conductor pipe 120 is coupled to the landing ring 116 via a groove 116*b* defined by a landing shoulder 116*a*. As described herein, an outer diameter of the landing ring 116 is configured to receive a riser connector 122 (as shown in FIG. 7).

In some embodiments, the engagement ring 114 distribute at least a portion of the load from the wellhead 110 to the landing ring 116 and the coupled conductor pipe 120. As illustrated, an outer diameter of the engagement ring 114 can be in contact with an inner portion of the wellhead 110 to receive at least a portion of the load from the wellhead 110. In the depicted example, the engagement ring 114 transfers load from the wellhead 110 to the mandrel hanger 112 and the load ring 118, which in turn directs load to the landing ring 116. In the illustrated embodiment, the inner diameter of the engagement ring 114 couples to the outer diameter of the mandrel hanger 112. In some embodiments, the engagement ring 114 is coupled to the mandrel hanger 112 via threads. Further, a lower surface of the engagement ring 114 may be in contact with an upper surface of the load ring 118 to transfer load of the wellhead 110 directly to the load ring 118.

In some embodiments, a rough casing seal (RCS) ring 126 isolates the mandrel hanger 112 and the wellhead 110 from the wellbore. In the depicted example, the RCS ring 126 includes a metallic sealing material to engage with the mandrel hanger 112 and the wellhead 110 to prevent flow between the interface between the mandrel hanger 112 and the wellhead 110. As illustrated, the RCS ring 126 can be disposed between the mandrel hanger 112 and the engagement ring 114. During operation, the engagement ring 114 can be compressed relative to the mandrel hanger 112 to energize the RCS ring 126 and compress the metallic sealing material therein, allowing the RCS ring 126 to isolate the mandrel hanger 112 and the wellhead 110. In the illustrated embodiment, one or more lock screws 130 extending through the wellhead 110 can engage with the outer surface engagement ring 114. to compress and energize the engagement ring 114 and in turn, the RCS ring 126.

Figure 10:
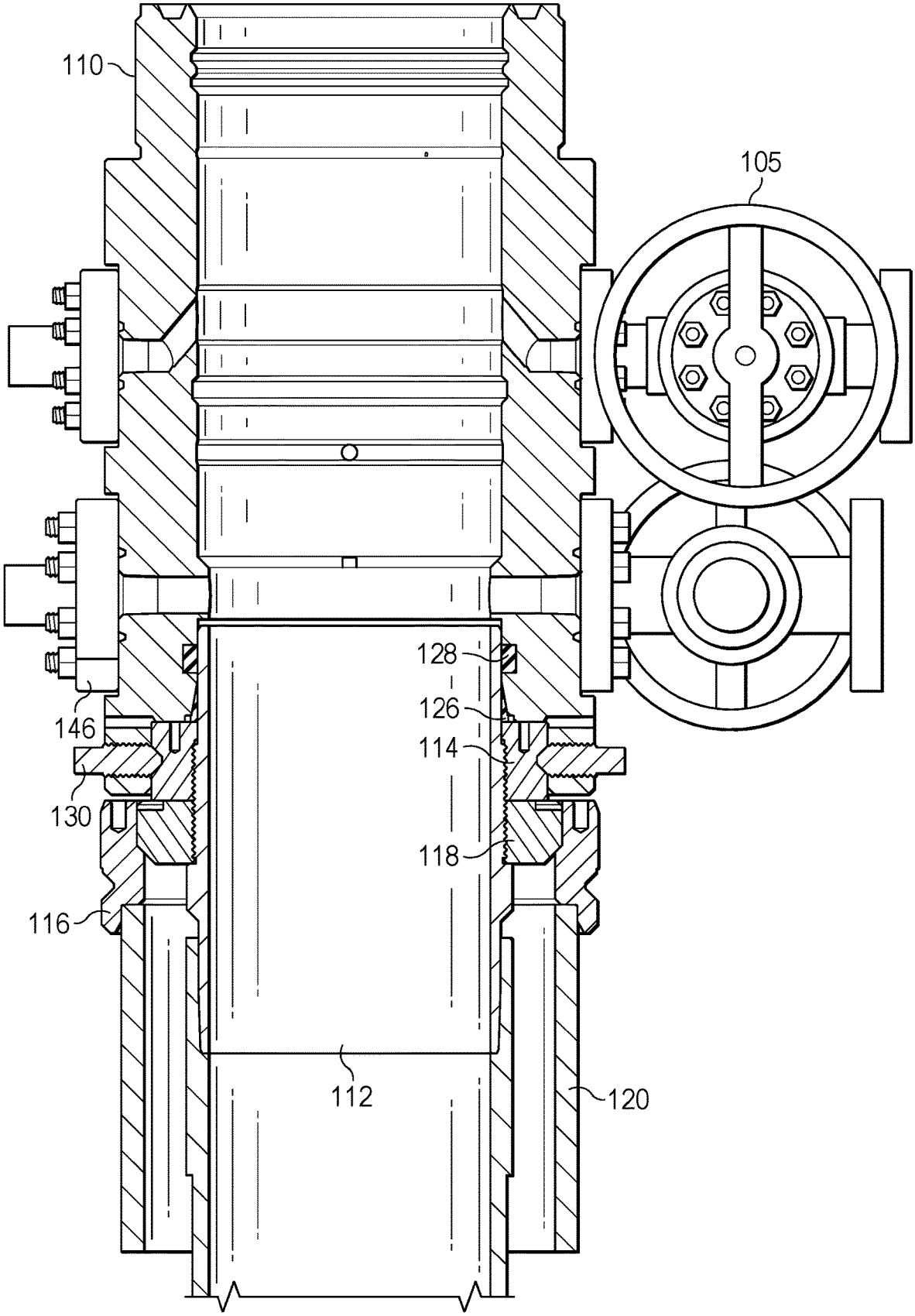
FIG. 10 is a cross-sectional side view of an example configuration of a wellhead system, in accordance with embodiments of the present disclosure.

In some embodiments, an elastomer bushing seal (EBS) 128 further isolates the mandrel hanger 112 and the wellhead 110 from the wellbore. In the depicted example, the EBS ring 128 is disposed between the mandrel hanger 112 and the wellhead 110. A test port 146 (as illustrated in FIG. 10) facilitates testing for the integrity of the RCS ring 126 and EBS 128. The test port 146 provides fluid communication with a volume defined between the mandrel hanger 112 and the wellhead 110 to allow an operator to test the connection integrity between the wellhead 110 and the mandrel hanger 112.

FIGS. 2-5 and 8-10 depict a method for installing the wellhead support assembly 100. Advantageously, the wellhead support assembly 100 utilizes a landing ring 116 that works in a variety of applications. In some embodiments, the landing ring 116 can be compatible with various 20" conductor applications.

As shown in FIG. 2, the landing ring 116 is coupled to a conductor pipe 120. In some embodiments, the landing ring 116 is welded onto the conductor pipe 120. Optionally, the landing ring 116 can be welded "pre-spud" before a rig arrives on site. In some embodiments, the conductor pipe 120 has an outer diameter of 20". Advantageously, the landing ring 116 can be used in multiple applications, including with 13⅝" 5M and 10M systems, as well as for through-rotary, air drilling, and diverter use. Further, the secured landing ring 116 can be available to support a slip hanger for stuck casing contingencies, as described herein.

Figure 3:
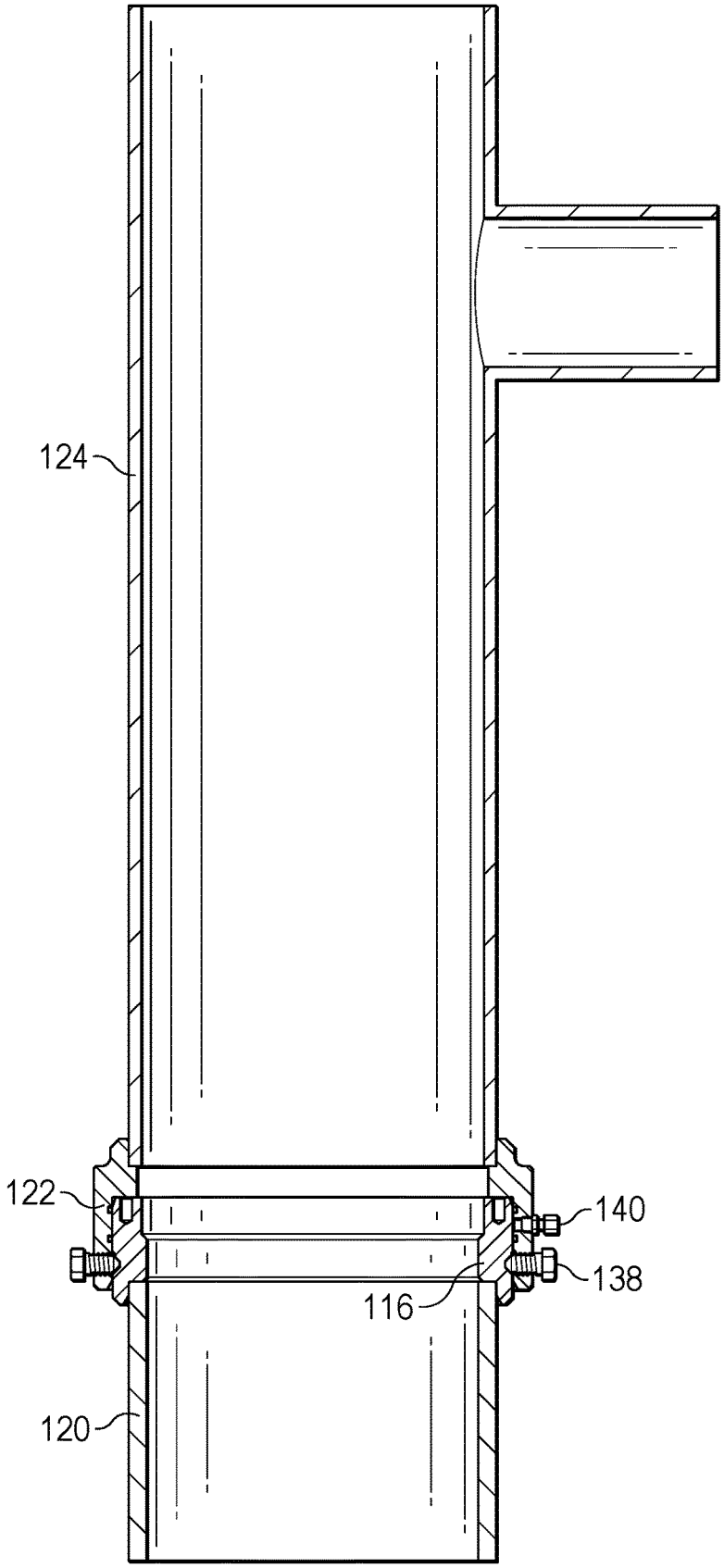
FIG. 3 is a cross-sectional side view of a landing ring with a riser connector, in accordance with embodiments of the present disclosure.

As illustrated in FIG. 3, a diverter or riser pipe 124 is configured to be coupled to the landing ring 116 to facilitate the conveyance and installation of the mandrel hanger 112. As illustrated, a riser connector 122 is connected to a riser pipe 124 to facilitate a connection to the landing ring 116. As described above, the riser connector 122 is configured to engage with the outer diameter of the landing ring 116.

Advantageously, the mandrel hanger 112 and running tool 142 (illustrated in FIG. 4) can have a smaller outer diameter compared to certain conventional wellhead attachment systems, which enables the use of smaller diameter riser pipe compared to certain conventional systems, which is cheaper and more commonly available compared to larger or more specialized riser pipes. In the illustrated embodiment, the riser pipe 124 has an inner diameter of around 19" or smaller and an outer diameter of around 20" or smaller. Advantageously, smaller and cheaper 19" inner diameter diverters can be used compared to certain conventional systems that may use risers or diverters with inner diameters of approximately 23 to 25 inches and outer diameters of approximately 24 to 26 inches. Further, the riser connector 122 can have a one piece construction compared to certain conventional applications which utilize two-piece riser connectors with a pin and box connector. Optionally, lock screws 138 can engage with the landing ring 116 and lock the riser connector 122 to the landing ring 116. The lock screws 138 can extend through the riser connector 122 and engage with the landing ring 116. In some embodiments, the riser connector 122 includes a test port 140 in fluid communication with a volume defined between the riser connector 122 and the landing ring 116 to allow an operator to test the connection integrity between the riser connector 122 and the landing ring 116.

Figure 4:
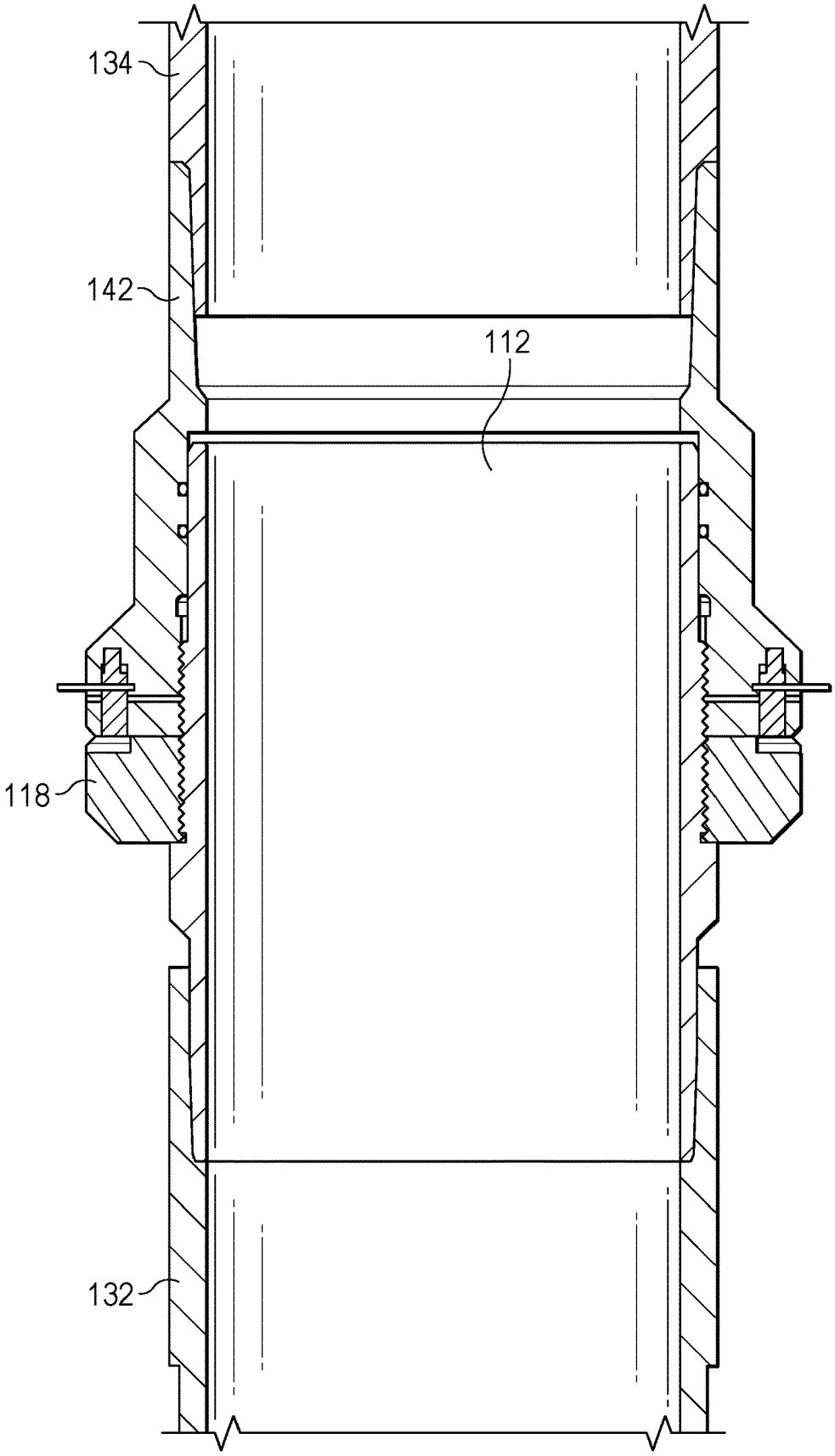
FIG. 4 is a cross-sectional side view of a mandrel hanger connected to a running tool, in accordance with embodiments of the present disclosure.

FIG. 4 is a cross-sectional side view of a mandrel hanger 112 connected to a running tool 142, in accordance with embodiments of the present disclosure. As shown in FIG. 4, the mandrel hanger 112 is connected to a running tool 142 to convey the mandrel hanger 112 through the riser pipe 124 and to set the mandrel hanger 112 within the landing ring 116. In the depicted example, the mandrel hanger 112 is releasably coupled to the running tool 142. As illustrated, the running tool 142 is connected to a landing joint 134. The landing joint 134 can be torqued to secure the landing joint 134 onto the running tool 142. Further, a casing joint 132 is installed or otherwise coupled to a lower portion of the mandrel hanger 112. Advantageously, the running tool 142 can avoid the use of a pup joint and/or bucking charges which may be required with certain conventional systems. Additionally, in the illustrated embodiment, the mandrel hanger 112 can be rotated to facilitate handling and alignment of the mandrel hanger 112.

Advantageously, the lightweight equipment shown in the illustrated embodiment reduces the cost of installation and is easier to handle compared to certain conventional components. For example, embodiments of the running tool 142 can weigh approximately 230 pounds and embodiments of the mandrel hanger 112 can weigh approximately 250 pounds. In conventional casing systems, the running tool can weigh approximately 600 pounds and the wellhead can weigh approximately 1,900 pounds, which can increase the cost of the casing system and the cost to torque the components of the conventional system.

Figure 5:
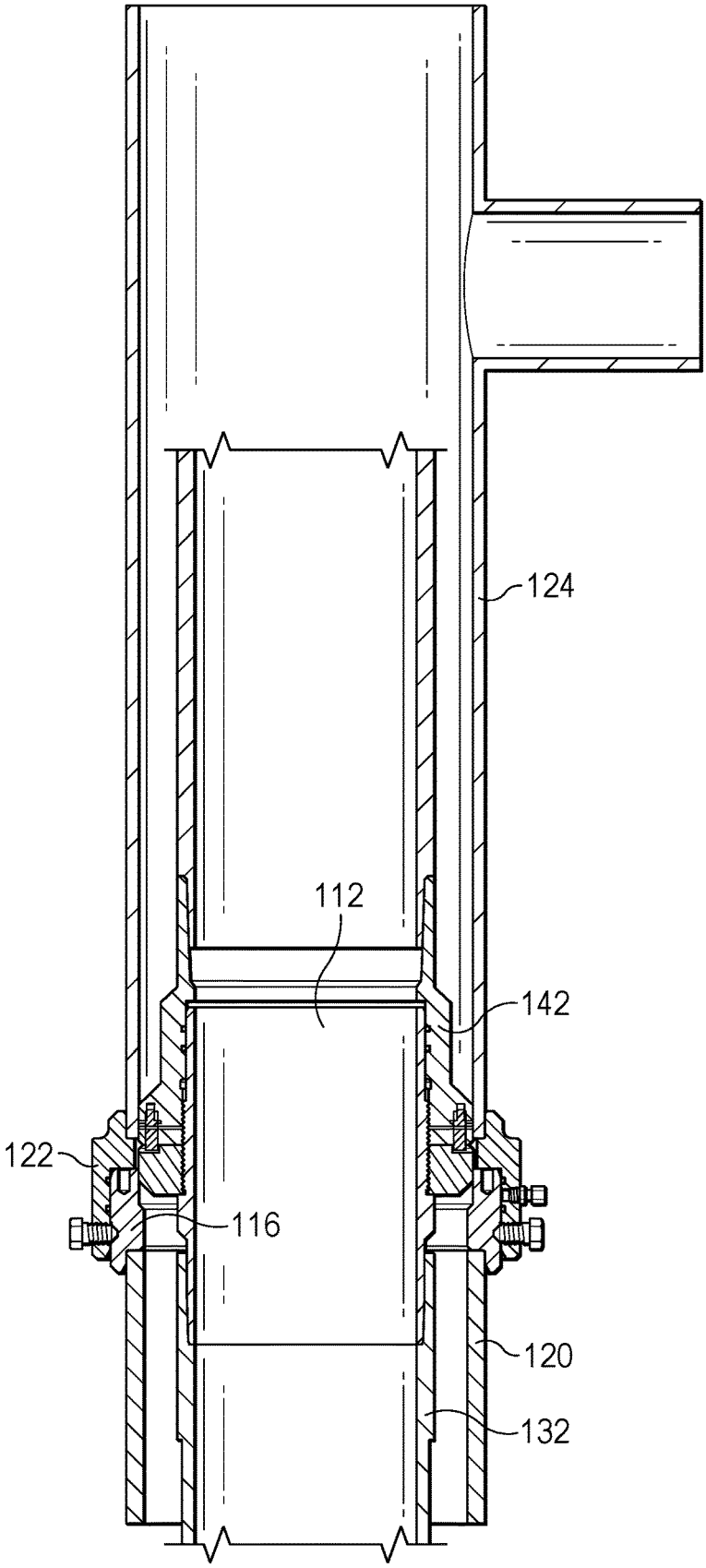
FIG. 5 is a cross-sectional side view of a mandrel hanger disposed within the landing ring, in accordance with embodiments of the present disclosure.

FIG. 5 is a cross-sectional side view of a mandrel hanger 112 disposed within the landing ring 116, in accordance with embodiments of the present disclosure. In the depicted example, the running tool 142 is advanced through the riser pipe 124 to land the mandrel hanger 112 within the landing ring 116. In some applications, the running tool 142 can run the mandrel hanger 112 through a 20" riser pipe, as illustrated in FIG. 5. In some embodiments, the mandrel hanger 112 is a tubular pipe with an inner diameter ranging between approximately 8 to 15 inches and an outer diameter between approximately 15 to 25 inches. In some applications, the mandrel hanger 112 has an inner diameter of approximately 13⅜" inches and an outer diameter of approximately 18.88 inches. Advantageously, the relatively compact dimensions and weight of the mandrel hanger 112 can allow the mandrel hanger 112 to be readily conveyed to a desired location via relatively small diverters compared to certain conventional casing systems. In some applications, the mandrel hanger 112 can be conveyed to a desired location via a diverter with an inner diameter of approximately 19 inches.

Figure 6A:
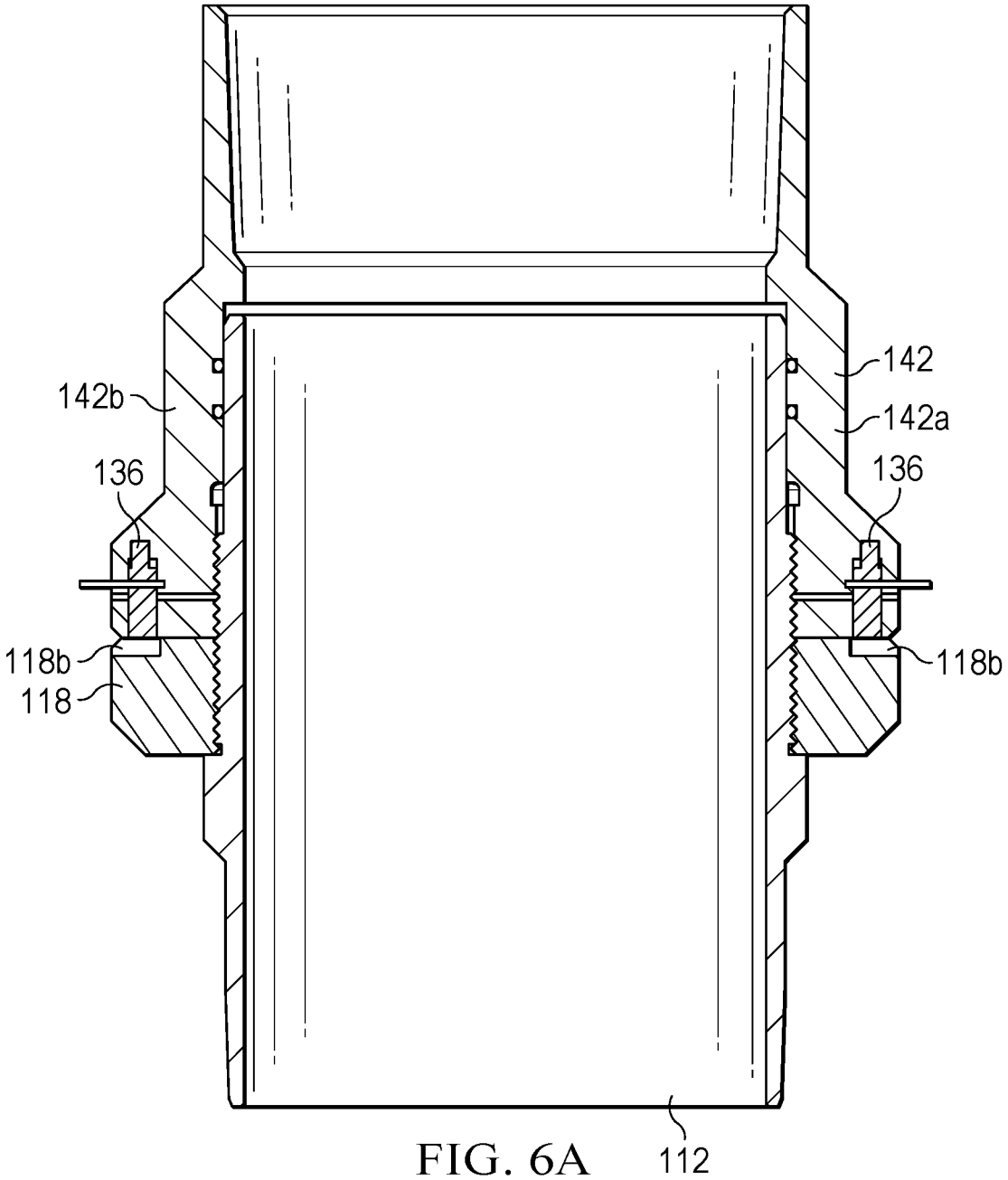
FIG. 6A is a cross-sectional side view of a mandrel hanger disposed within the landing ring, in accordance with embodiments of the present disclosure.
Figure 6B:
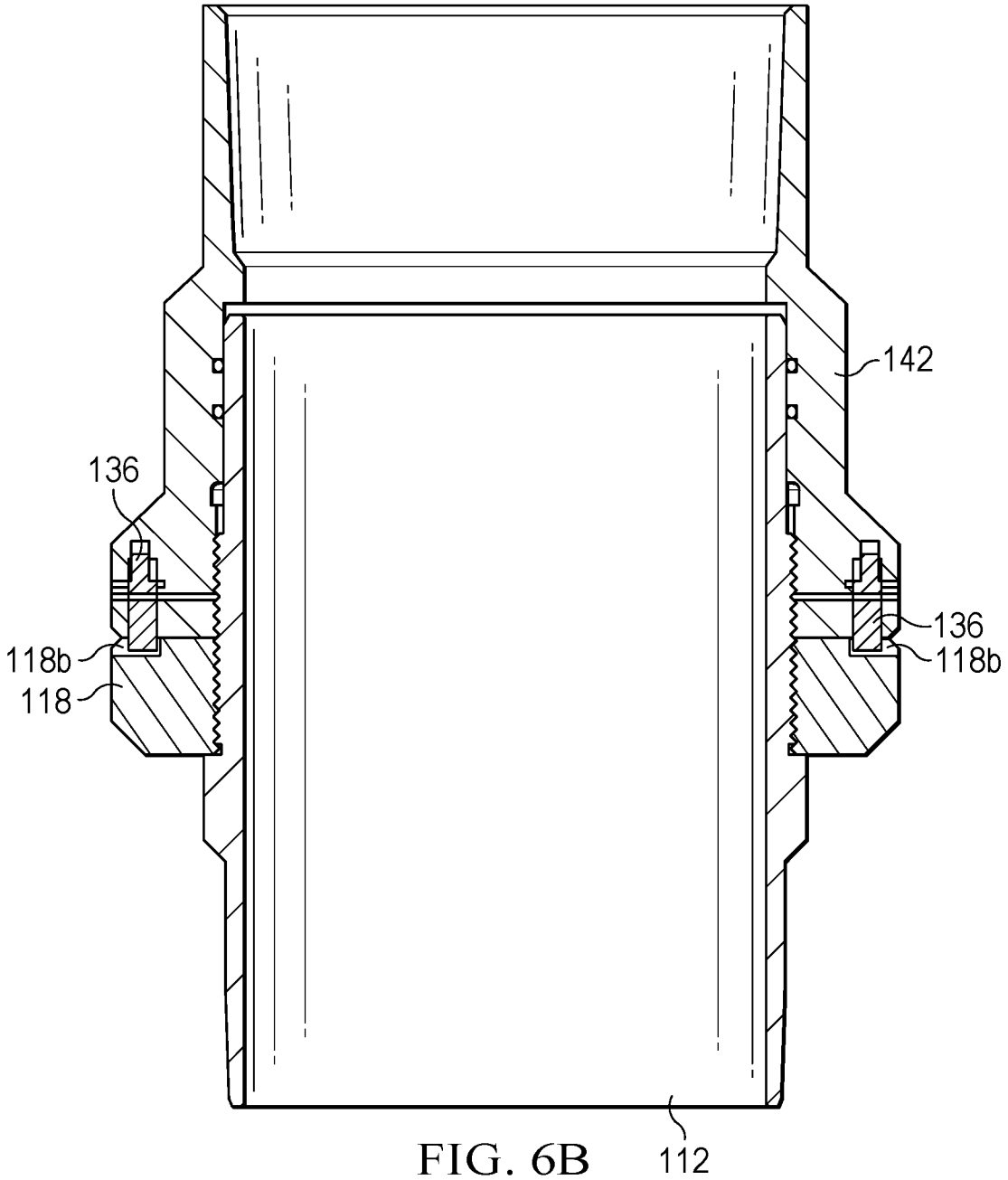
FIG. 6B is a cross-sectional side view of a mandrel hanger disposed within the landing ring, in accordance with embodiments of the present disclosure.

As illustrated in FIGS. 6A and 6B, during the landing process, the running tool 142 engages with load ring 118 to land the mandrel 112 and the load ring 118 within the landing ring 116. In the depicted example, the running tool 142 includes at least two pins 136 disposed on either leg 142*a* or 142*b* of the running tool 142 to engage with the load ring 118. As illustrated in FIG. 6A, as the mandrel hanger 112 is conveyed through the riser pipe 124, the pins 136 can be retracted relative to the load ring 118.

Figure 8:
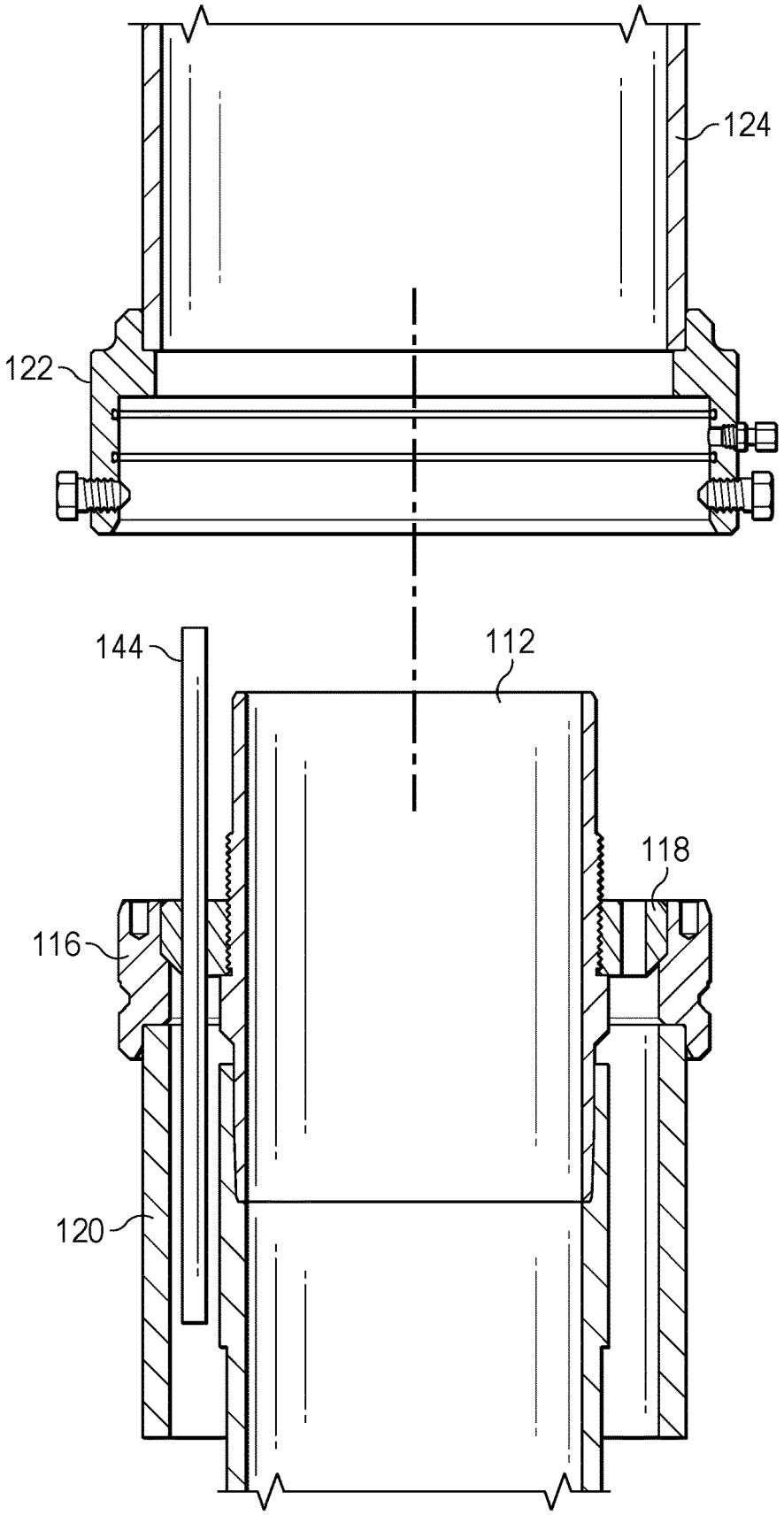
FIG. 8 is a cross-sectional side view of the removal of a riser connector from the landing ring, in accordance with embodiments of the present disclosure.

With reference to FIG. 6B, during the landing process the pins 136 are extended from the running tool 142 to contact or engage with the load ring 118. In some embodiments, the pins 136 of the running tool 142 are configured to engage with a groove 118*b* defined by the outer surface of the load ring 118. During operation, the engagement of the pins 136 with the groove 118*b* of the load ring 118 can land, lock, or otherwise couple the load ring 118 with the mandrel hanger 112 and/or the landing ring 116, as depicted in FIG. 7. As illustrated in FIG. 8, the riser connector 122 is removed from the landing ring 116 once the mandrel hanger 112 and load ring 118 are set within the landing ring 116. In the depicted example, the riser pipe 124 and riser connector 122 only need to be lifted approximately 14 inches to clear the mandrel hanger 112. Advantageously, the riser removal is simpler and faster with a one-piece riser and reduced lift height compared to certain conventional systems. In comparison, in conventional casing processes the riser removal is more labor intensive and time consuming because two pieces need to be removed from the landing ring and raised to a higher height to clear the installed components. Further, once the riser connector 122 is removed, features or ports in the landing ring 116 allow for a low pressure wash pipe 144 to extend vertically therethrough, which allows for less flow obstruction that certain conventional systems that force the wash pipe to extend at an angle relative to the landing ring. In some embodiments, the low pressure wash pipe 144 has a diameter of approximately 1 inch.

Figure 9:
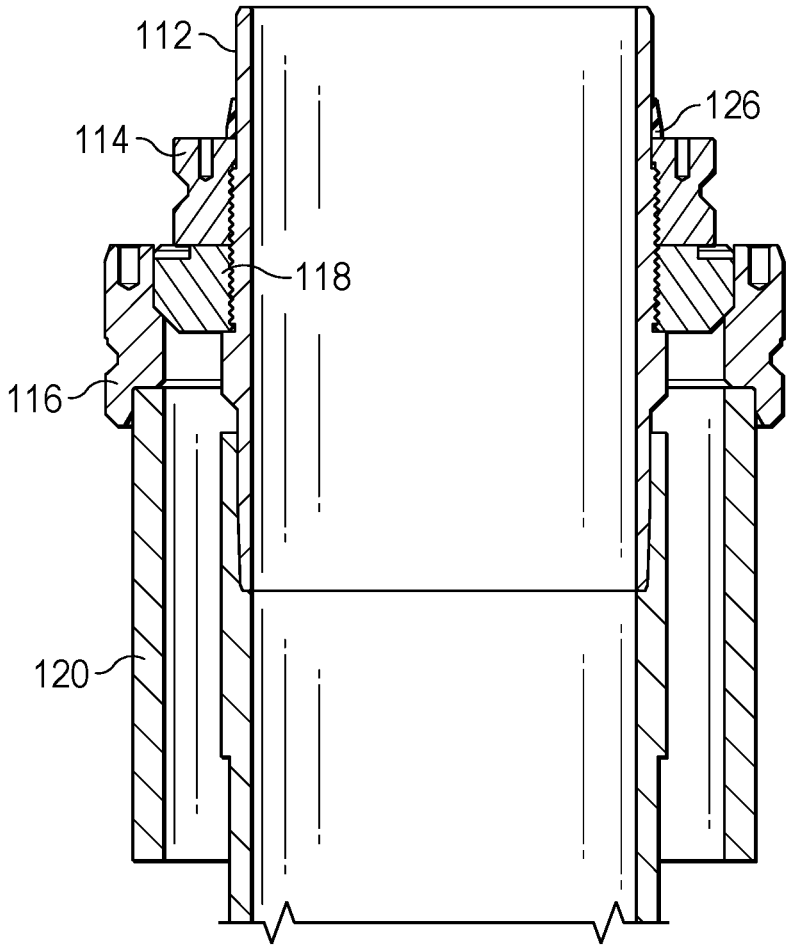
FIG. 9 is a cross-sectional side view of the landing ring with the engagement ring, in accordance with embodiments of the present disclosure.

As illustrated in FIG. 9, once the riser connector 122 is removed, the engagement ring 114 can be threadedly coupled to the mandrel hanger 112. The engagement ring 114 provides an interface between the wellhead 110 and the mandrel hanger 112. In some embodiments, the engagement ring 114 can be threaded on by hand. The RCS ring 126 is then coupled to the engagement ring 114. The RCS ring 126 isolates the wellhead 110 and the mandrel hanger 112 from the wellbore fluids. Advantageously, the simplified preparation for the wellhead installation saves at least one or two hours in preparation time compared to certain conventional systems which may require the removal and installation of plugs, studs, valves, and flanges.

Figure 11:
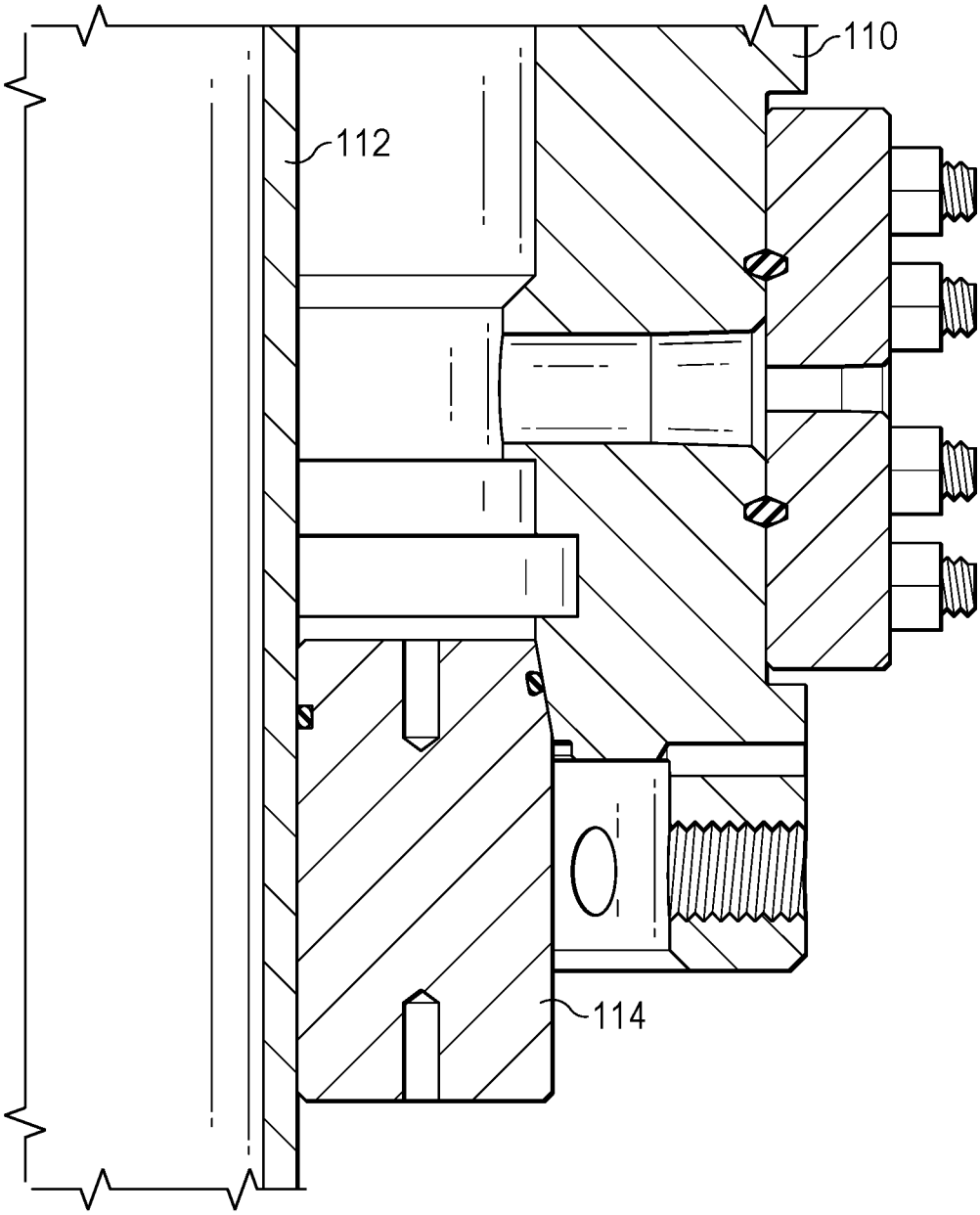
FIG. 11 is a cross-sectional side view of the engagement ring connection with the wellhead, in accordance with embodiments of the present disclosure.

As illustrated in FIG. 10, the wellhead 110 is then disposed onto the mandrel hanger 112 and engagement ring 114. In some embodiments, the mandrel hanger 112 extends through the bore of the wellhead 110 to at least partially align the wellhead 110 relative to the mandrel hanger 112 and the engagement ring 114. As illustrated in FIG. 11, the load of the wellhead 110 may be supported by the engagement ring 114, which may in turn distribute the load to the hanger mandrel 112, the load ring 118, and the landing ring 116.

In some embodiments, the wellhead 110 can then be locked into place via the lock screws 130. The lock screws 130 extend through the wellhead 110 and engage with the engagement ring 114. As discussed above, the compression or engagement of the engagement ring 114 can energize the RCS seal 126 to provide a seal between the wellbore and the wellhead 110 and mandrel hanger 112. The integrity of RCS seal 126 can be tested through test port 146 after the wellhead 110 is secured to the engagement ring 114.

During installation of the casing, the casing string is run by joining the casing with connections, which may normally be threaded connections. At times, the casing string can become stuck during operations. If the surface casing becomes stuck, the operator will have to disconnect and install alternative equipment requiring special tools and labor. A contingency wellhead system can be used to control fluid flow through a wellbore in applications where casing may be stuck in a wellbore. As illustrated, the contingency wellhead can be in fluid communication with stuck casing to gain control of fluid within the wellbore. In some applications, since the hardware to install a wellhead in stuck casing contingencies is different than the hardware used for "routine" wellhead installations, installing a contingency wellhead can be time consuming and require specialized tools and skills. The present disclosure utilizes apparatuses and methods which enables an operator to cut the casing without disassembling the wellhead and changing the elevation, significantly reducing the amount of time and cost needed to repair the stuck casing.

Figure 12:
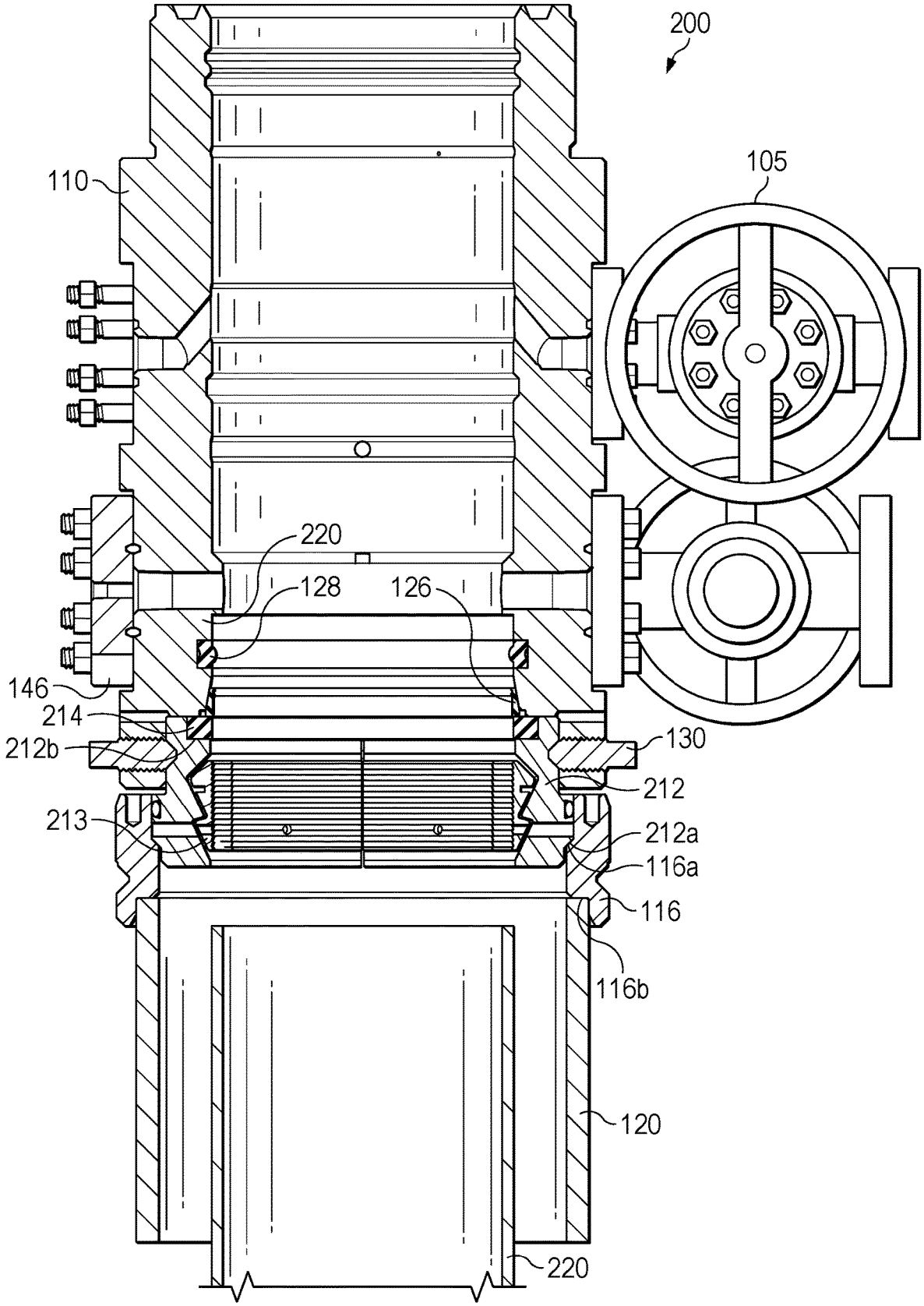
FIG. 12 is a cross-sectional side view of an example configuration of a wellhead system with a slip hanger, in accordance with embodiments of the present disclosure.

FIG. 12 illustrates a cross sectional side view of an example configuration of a wellhead 110 supported by a slip hanger assembly 200 in accordance with embodiments of the present disclosure. With reference to FIG. 12, the wellhead 110 can be used to control the flow of fluids to and from a wellbore. As illustrated, the wellhead 110 can include one or more valves 105 to control the flow of fluid through the wellhead 110 and the wellbore. In the depicted example, the slip hanger 212 can provide fluid communication between the wellhead 110, the casing, and the wellbore.

As illustrated in FIG. 12, the slip hanger 212 can support the wellhead 110 relative to a stuck casing 220 and/or the conductor pipe 120. In some embodiments, a portion of the stuck casing 220 can extend into a portion of the wellhead 110 to stabilize the wellhead 110 relative to the conductor pipe 120.

In the depicted example, the slip hanger 212 engages with an outer surface of the stuck casing 220. The inner diameter of the slip hanger 212 includes one or more slip elements 213. The slip elements 213 engage with and support the stuck casing 220. During operation, the gravity and weight of the stuck casing 220 forces the slip elements 213 to engage the outer surface of the stuck casing 220. It would be understood by one of skill in the art would understand that various embodiments of the slip hanger 212 can include any suitable slip mechanism.

The slip hanger 212 is supported by or coupled to the landing ring 116. In the illustrated embodiment, the slip hanger 212 is disposed around and coupled to the stuck casing 220 to facilitate a connection between the stuck casing 220 and the landing ring 116. As illustrated, an outer ring or outer surface 212*a* of the slip hanger 212 is configured to engage with an inner surface of the landing ring 116 to support the load of the slip hanger 212. In some embodiments, the outer surface 212*a* of the slip hanger 212 defines an angled or beveled surface configured to engage with a mating surface of the landing ring 116. The angle of the beveled surface can range from approximately 0 degrees to 10 degrees.

In the depicted example, the landing ring 116 depicted in FIG. 12 can have the same features as the landing ring 116 discussed with reference to FIG. 1, since the landing ring 116 can be configured to receive either of a slip hanger 212 or the mandrel hanger 112. In the illustrated embodiment, the inner diameter of the landing ring 116 includes a shoulder 116*a* configured to receive the slip hanger 212. As illustrated, the shoulder 116*a* can extend radially inward from an inner surface of the landing ring 116. The landing ring 116 and landing shoulder 116*a* will include features that are complimentary to the outer surface 212*a* of the slip hanger 212. As illustrated, the shoulder 116*a* of the landing ring 116 is configured to engage with an outer surface 212*a* of the slip hanger 212 to support the load of the slip hanger 212. In some embodiments, the landing shoulder 116*a* of the landing ring 116 defines an angled or beveled surface configured to engage with a mating surface of the slip hanger 212. In some embodiments, the angled or beveled surface of the landing shoulder 116*a* and/or the slip hanger outer surface 212*a* can allow the landing ring 116 and/or the slip hanger 212 to self-centralize or align during engagement. The angle of the beveled surface can range from approximately 0 degrees to 10 degrees.

Figure 13:
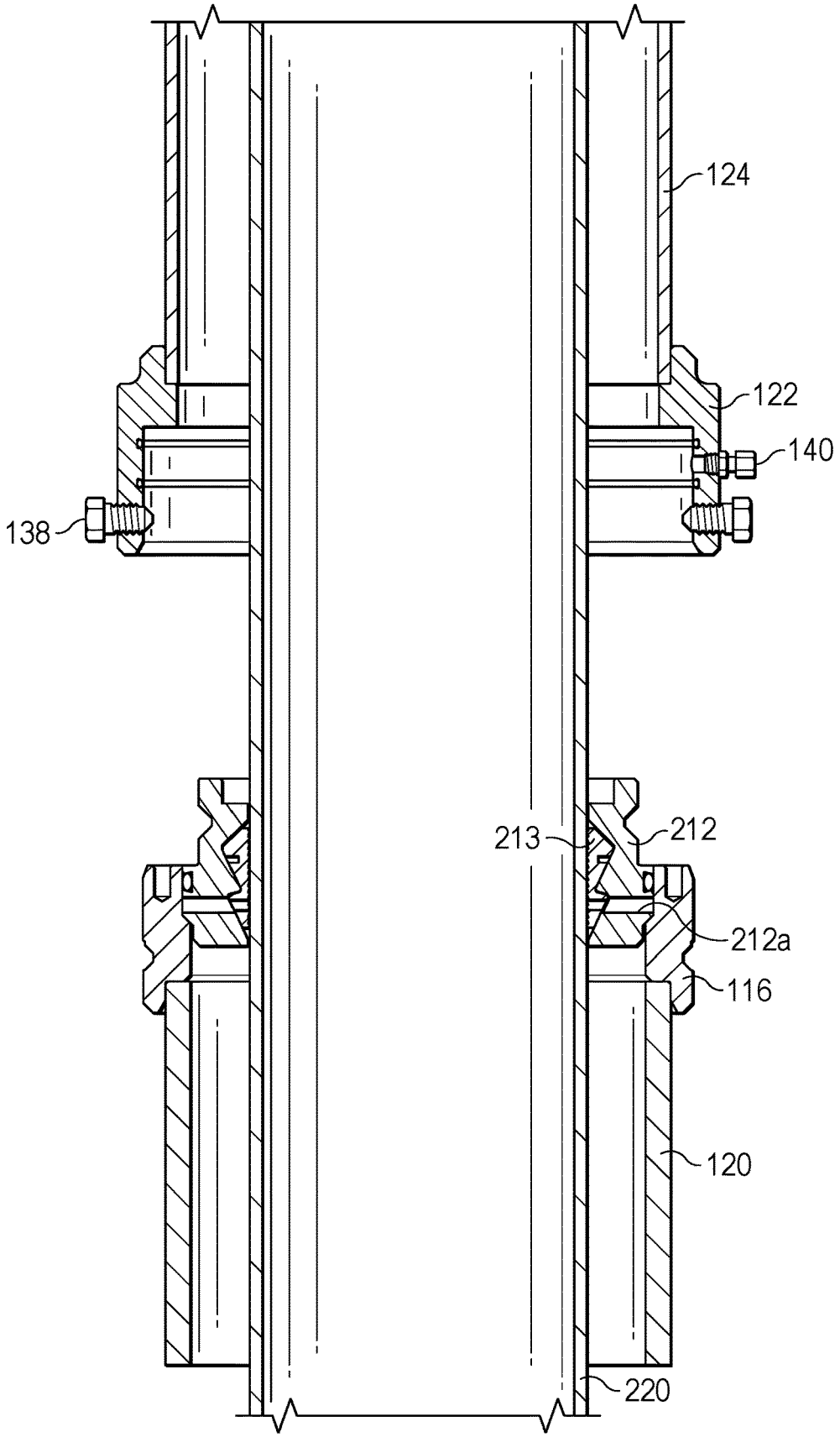
FIG. 13 is a cross-sectional side view of a riser connector with the slip hanger configuration, in accordance with embodiments of the present disclosure.

The landing shoulder 116*a* of the landing ring 116 distributes the load from the slip hanger 212 to the landing ring 116 and the coupled conductor pipe 120. Compared to certain conventional systems, the landing ring 116 can have a sufficient thickness and/or material properties to support the slip hanger 212, the stuck casing 220, and the wellhead 110, as needed. In addition, the self-centralizing function performed by the angled or beveled surface of landing shoulder 116*a* allows landing ring 116 to receive and distribute more load than similar components in certain conventional systems, which may deform due to load distribution that is uneven or offset in relation to the central axis of the casing. In some embodiments, the conductor pipe 120 is coupled to the landing ring 116 via a groove 116*b* defined by a landing shoulder 116*a*. In some embodiments, since the features of the landing ring 116 are configured to also support the mandrel hanger 112, the landing ring 116 may already be installed on the conductor pipe 120 to support the mandrel hanger 112. Therefore, in some embodiments, the landing ring 116 may be readily available to support a slip hanger 212 for a stuck casing contingency. As described herein, an outer diameter of the landing ring 116 is configured to receive a riser connector 122 (as shown in FIG. 13).

In some embodiments, the base ring 214 distributes at least a portion of the load from the wellhead 110 to the landing ring 116 and the coupled conductor pipe 120. In the illustrated embodiment, the base ring 214 is set within a groove 212*b* of the slip hanger 212. The outer surface of the base ring 214 contacts the wellhead 110.

In some embodiments, a rough casing seal (RCS) ring 126 isolates the slip hanger 212 and the wellhead 110 from the wellbore. In the depicted example, the RCS ring 126 includes a metallic sealing material to engage with the slip hanger 212 and the wellhead 110 to prevent flow between the interface between the slip hanger 212 and the wellhead 110. As illustrated, the RCS ring 126 can be disposed between the slip hanger 212 and/or the base ring 214 and the wellhead 110. During operation, the slip hanger 212 and/or the base ring 214 can be compressed relative to the stuck casing 220 to energize the RCS ring 126 and compress the metallic sealing material therein, allowing the RCS ring 126 to isolate the slip hanger 212 and the wellhead 110. In the illustrated embodiment, one or more lock screws 130 extending through the wellhead 110 can engage with the outer surface of the slip hanger 212 to compress and energize the slip hanger 212 and/or the base ring 214 to compress and energize the slip hanger 212 and/or the base ring 214, and in turn the RCS ring 126.

In some embodiments, an elastomer bushing seal (EBS) 128 further isolates the slip hanger 212 and the wellhead 110 from the wellbore. In the depicted example, the EBS ring 128 is disposed on the stuck casing 220 above the slip hanger 212 between the stuck casing 220 and the wellhead 110. A test port 146 facilitates testing for the integrity of the RCS ring 126 and EBS 128. The test port 146 provides fluid communication with a volume defined between the slip hanger 212 and the wellhead 110 to allow an operator to test the connection integrity between the wellhead 110 and the slip hanger 212.

Figure 14:
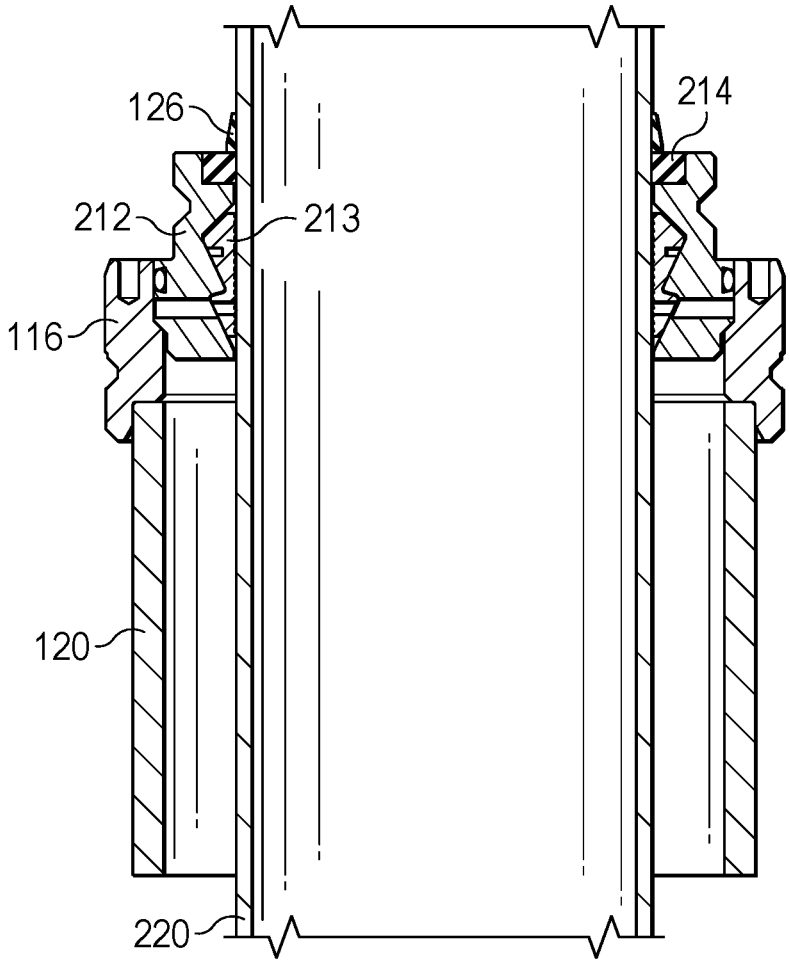
FIG. 14 is a cross-sectional side view of a slip hanger configuration, in accordance with embodiments of the present disclosure.
Figure 15:
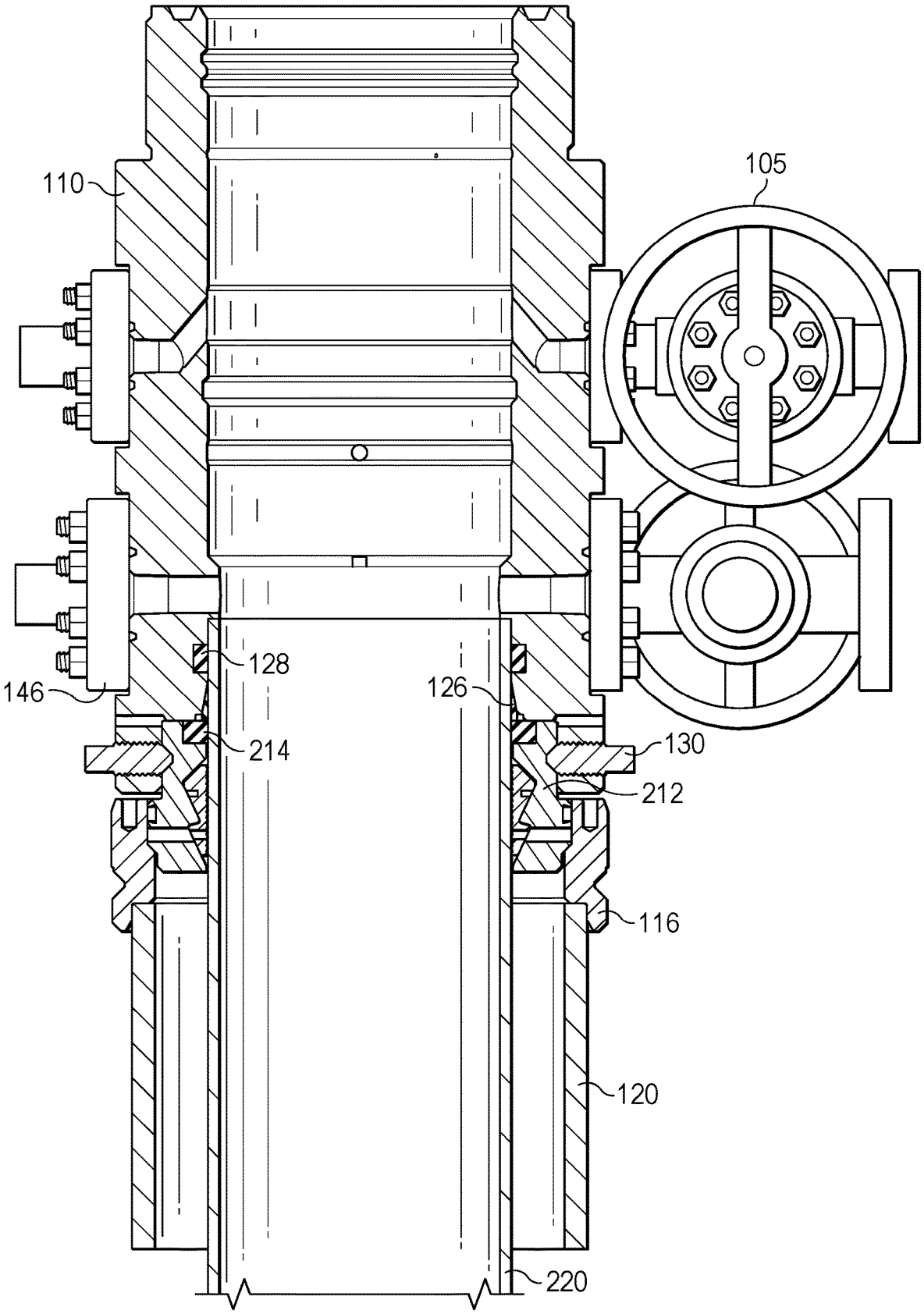
FIG. 15 is a cross-sectional side view of an example configuration of a wellhead disposed on a slip hanger configuration, in accordance with embodiments of the present disclosure.

FIGS. 13-15 depict a method for installing the slip hanger assembly 200. Advantageously, the slip hanger assembly 200 reduces the time and cost needed to handle the stuck casing. Further, the slip hanger assembly 200 utilizes the landing ring 116 discussed above that is compatible with a variety of applications. In some embodiments, the landing ring 116 is compatible with all 20" conductor applications. The illustrated embodiment also reduces the need for an operator to maintain an inventory of slip-on-wellheads for contingency operations.

As shown in FIG. 13, the landing ring 116 is coupled to a conductor pipe 120 as is discussed with reference to FIG. 2 above. In some embodiments, the landing ring 116 can be coupled to the conductor pipe 120 before a rig arrives on site or otherwise originally in preparation to support a mandrel hanger 112, but readily available to support a slip hanger 212 and/or the stuck casing 220. After a stuck casing condition is identified, the stuck casing 220 can be cemented to support at least a portion of the load of the stuck casing 220, a riser connector 122 can be disconnected from the landing ring 116 and the riser pipe 124 can be lifted relative to the landing ring 116, the conductor pipe 120, and the stuck casing 220.

After the riser connector 122 and the riser pipe 124 are lifted relative to the stuck casing 220, the slip hanger 212 can be conveyed or otherwise disposed around the stuck casing 220. The weight of the stuck casing 220 can be utilized to energize or otherwise engage the stuck casing 220 with the landing ring 116. In the depicted example, the weight of the stuck casing 220 can be used to energize or otherwise engage the slip elements 213 of the slip hanger 212 against the outer surface of the stuck casing 220 to allow the stuck casing 220 to be coupled to the slip hanger 212. Additionally, the weight of the stuck casing 220 can also be utilized to engage the outer surface ring 116 to support the stuck casing 220 or otherwise coupling the stuck casing 220 with the landing ring 116. In some applications, a portion of the stuck casing 220 can be stretched to allow the tension of the stretched stuck casing 220 to energize the slip hanger 212 and/or couple the slip hanger 212 with the landing ring 116.

As illustrated in FIG. 14, after the stuck casing 220 is set relative to the landing ring 116, the stuck casing 220 can be cut and beveled. After cutting the stuck casing 220, the base ring 214 can be positioned within a groove of the slip hanger 212. In some embodiments, the base ring 214 can be installed by hand. Further, the RCS ring 126 is then coupled to the base ring 214. The RCS ring 126 isolates the wellhead 110, the stuck casing 220, and the slip hanger 212 from the wellbore fluids.

As illustrated in FIG. 15, the wellhead 110 is then disposed onto the cut and beveled stuck casing 220, the slip hanger 212, and the base ring 214. In some embodiments, the stuck casing 220 extends through the bore of the wellhead 110 to at least partially align the wellhead 110 relative to the stuck casing 220, the slip hanger 212, and/or the base ring 214. The load of the wellhead 110 can be supported by the base ring 214 and the slip hanger 212, which may in turn distribute the load to the stuck casing 220 and the landing ring 116.

In some embodiments, the wellhead 110 can then be locked into place via the lock screws 130. The lock screws 130 extend through the wellhead 110 and engage with the slip hanger 212. As discussed above, the compression or engagement of the slip hanger 212 and/or the base ring 214 can energize the RCS seal 126 to provide a seal between the wellbore and the wellhead 110, the stuck casing 220, and slip hanger 212. The integrity of the RCS seal 126 can be tested through test port 146 after the wellhead 110 is secured to the slip hanger 212.

Figure 16:
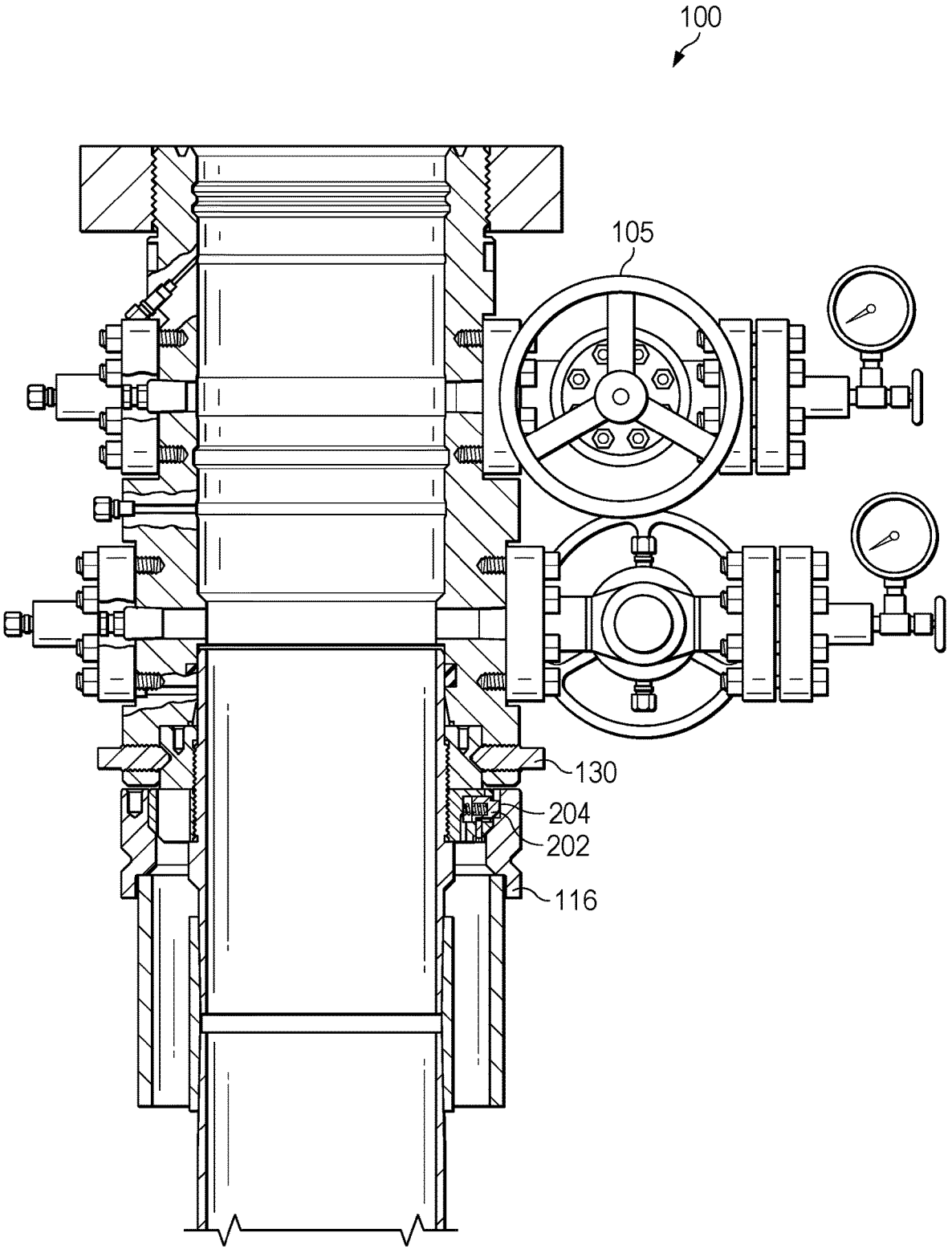
FIG. 16 is a cross-sectional side view of the exemplary embodiment shown in FIG. 1, with the addition of a radial load ring locking mechanism.

As one of ordinary skill in the art will understand, during cementing operations, the cement will exert an upward force on the casing until the cement has cured and solidified. Accordingly, this buoyancy may cause a casing hanger to lift upwards away from the wellhead. To address this issue, a radial load ring locking mechanism 202 may be used to prevent axial separation of load ring 118 and landing ring 116. As shown in FIG. 16, radial load ring locking mechanism 202 may comprise a spring-loaded pin that is disposed within load ring 118. As load ring 118 is moved into position, the pin will spring radially outward to engage groove 204 formed in landing ring 116. Although a spring-loaded pin is the simplest and preferred embodiment, any locking mechanism could be used that is oriented in a generally radial direction and configured to prevent relative axial movement of load ring 118 and locking ring 116. For example, lock screws similar to those discussed above could be used, as well as locking dogs and other mechanism that are well-known to one of ordinary skill in the art.

It is understood that variations may be made in the foregoing without departing from the scope of the present disclosure. In several exemplary embodiments, the elements and teachings of the various illustrative exemplary embodiments may be combined in whole or in part in some or all of the illustrative exemplary embodiments. In addition, one or more of the elements and teachings of the various illustrative exemplary embodiments may be omitted, at least in part, and/or combined, at least in part, with one or more of the other elements and teachings of the various illustrative embodiments.

Any spatial references, such as, for example, "upper," "lower," "above," "below," "between," "bottom," "vertical," "horizontal," "angular," "upwards," "downwards," "side-to-side," "left-to-right," "right-to-left," "top-to-bottom," "bottom-to-top," "top," "bottom," "bottom-up," "top-down," etc., are for the purpose of illustration only and do not limit the specific orientation or location of the structure described above.

In several exemplary embodiments, while different steps, processes, and procedures are described as appearing as distinct acts, one or more of the steps, one or more of the processes, and/or one or more of the procedures may also be performed in different orders, simultaneously and/or sequentially. In several exemplary embodiments, the steps, processes, and/or procedures may be merged into one or more steps, processes and/or procedures.

In several exemplary embodiments, one or more of the operational steps in each embodiment may be omitted. Moreover, in some instances, some features of the present disclosure may be employed without a corresponding use of the other features. Moreover, one or more of the above-described embodiments and/or variations may be combined in whole or in part with any one or more of the other above-described embodiments and/or variations.

Although several exemplary embodiments have been described in detail above, the embodiments described are exemplary only and are not limiting, and those skilled in the art will readily appreciate that many other modifications, changes and/or substitutions are possible in the exemplary embodiments without materially departing from the novel teachings and advantages of the present disclosure. Accordingly, all such modifications, changes, and/or substitutions are intended to be included within the scope of this disclosure as defined in the following claims. In the claims, any means-plus-function clauses are intended to cover the structures described herein as performing the recited function and not only structural equivalents, but also equivalent structures. Moreover, it is the express intention of the applicant not to invoke 35 U.S.C. § 112, paragraph 6 for any limitations of any of the claims herein, except for those in which the claim expressly uses the word "means" together with an associated function.

The invention claimed is:

1. A casing system, comprising:

a landing ring defining an opening extending between a first end portion and a second end portion, wherein the first end portion is configured to couple to a conductor pipe, the landing ring comprising a landing ring shoulder extending radially inward from an inner surface of the opening;

a mandrel hanger comprising a threaded outer surface;

a load ring comprising:

an upper radial surface;

an outer surface configured to engage with the landing ring shoulder; and a threaded inner surface configured to engage with the threaded outer surface of the mandrel hanger;

an engagement ring comprising:

a lower radial surface configured to abut the upper radial surface of the load ring; and a threaded inner surface configured to engage with the threaded outer surface of the mandrel hanger.

2. The casing system of claim 1, further comprising a radial load ring locking mechanism configured to prevent relative axial movement of the load ring and the landing ring.

3. The casing system of claim 2, wherein the radial load ring locking mechanism comprises a spring-loaded pin.

4. The casing system of claim 3, wherein the landing ring further comprises a groove configured to engage the spring-loaded pin.

5. The casing system of claim 2, wherein the landing ring shoulder defines a beveled surface configured to receive the load ring.

6. The casing system of claim 5, wherein the outer surface of the load ring defines a complimentary beveled surface configured to mate with the beveled surface of the landing ring shoulder.

7. The casing system of claim 2, further comprising a rough casing seal ring configured to engage the outer surface of the mandrel hanger.

8. The casing system of claim 7, further comprising lock screws configured to engage an outer surface of the engagement ring.

9. The casing system of claim 8, wherein the lock screws are configured to compress the rough casing seal ring against the outer surface of the mandrel hanger.

10. The casing system of claim 9, further comprising an elastomer bushing seal configured to engage the outer surface of the mandrel hanger.

11. A method for installing a casing system, the method comprising:

coupling a landing ring to a conductor pipe;

coupling a load ring comprising a radial upper surface and a threaded inner surface to a threaded outer surface of a mandrel hanger;

introducing the mandrel hanger and the load ring through an opening of the landing ring;

supporting the mandrel hanger via the landing ring by engaging an outer surface of the load ring with a landing ring shoulder extending radially inward from an inner surface of the opening of the landing ring;

coupling an engagement ring to the threaded outer surface of the mandrel hanger, such that a radial lower surface of the engagement ring abuts the radial upper surface of the load ring; and introducing a wellhead assembly onto the mandrel hanger and an upper radial surface of the engagement ring.

12. The method of claim 11, further comprising the step of engaging a radial load ring locking mechanism to prevent relative axial movement of the load ring and the landing ring.

13. The method of claim 12, wherein the radial load ring locking mechanism comprises a spring-loaded pin.

14. The method of claim 13, wherein the landing ring further comprises a groove configured to engage the spring-loaded pin.

15. The method of claim 14, wherein the step of engaging the radial load ring locking mechanism to prevent relative axial movement of the load ring and the landing ring comprises introducing the mandrel hanger and the load ring to an axial location at which the spring-loaded pin moves radially outward to engage the groove in the landing ring.

16. The method of claim 12, further comprising the steps of:

connecting a riser connector to a riser pipe; and locking the riser connector to the landing ring.

17. The method of claim 16, further comprising the step of connecting a running tool to the mandrel hanger.

18. The method of claim 17, further comprising the step of using the running tool to convey the mandrel hanger and the load ring through the riser pipe.

19. The method of claim 12, further comprising the step of disposing a rough casing seal ring about the outer surface of the mandrel hanger.

20. The method of claim 19, further comprising the steps of:

introducing lock screws configured to engage an outer surface of the engagement ring; and turning the lock screws to compress the rough casing seal ring against the outer surface of the mandrel hanger.

* * * * *